United States Patent [19]

Riszk et al.

[11] Patent Number: 4,785,787

[45] Date of Patent: Nov. 22, 1988

[54] FUEL INJECTION MECHANISM FOR AN INTERNAL COMBUSTION ENGINE

[75] Inventors: Reda R. Riszk, Cologne; Hans-Gottfried Michels, Erftstadt, both of Fed. Rep. of Germany

[73] Assignee: Kloeckner-Humboldt-Deutz AG, Fed. Rep. of Germany

[21] Appl. No.: 40,139

[22] Filed: Apr. 20, 1987

[30] Foreign Application Priority Data

Apr. 29, 1986 [DE] Fed. Rep. of Germany ..... 3614495

[51] Int. Cl.[4] ..... F02M 39/00

[52] U.S. Cl. ..... 123/506; 123/458; 137/599.2

[58] Field of Search ..... 123/506, 500, 501, 458; 137/599.2; 251/129.1

[56] References Cited

U.S. PATENT DOCUMENTS

| | | | |
|---|---|---|---|
| 3,779,225 | 12/1973 | Watson | 123/506 |
| 3,851,635 | 12/1974 | Murtin | 123/458 |
| 3,905,655 | 9/1975 | DeGenives | 137/599.2 |
| 4,418,670 | 12/1983 | Lakin | 123/506 |
| 4,505,243 | 3/1985 | Miwa | 123/458 |
| 4,604,981 | 8/1986 | Dazzi | 123/467 |
| 4,615,322 | 10/1986 | Dazzi | 123/506 |
| 4,619,239 | 10/1986 | Wallenfang | 123/506 |
| 4,644,968 | 2/1987 | Chattfrjea | 137/599.2 |
| 4,674,536 | 6/1987 | Warrick | 251/129.1 |

*Primary Examiner*—Carl Stuart Miller

*Attorney, Agent, or Firm*—Charles L. Schwab

[57] ABSTRACT

A fuel injection system for a diesel engine in which an electromagnetically actuated valve determines the initiation and conclusion of injection. A valve of this sort consists of a primary slide valve component 3 which, in its closed position, makes a seating engagement with a tapered valve seat 5 to close a connecting channel 16 between the injection line 10 and a dumping passage 12. The primary valve component is moved to its open position by an electromagnetically actuated impact bolt 40. In order to avoid problems associated with seat valves, a second electrically operated valve component 6 is provided in a second connecting channel 25 between the high pressure channel 7 and the dumping channel 12.

13 Claims, 1 Drawing Sheet

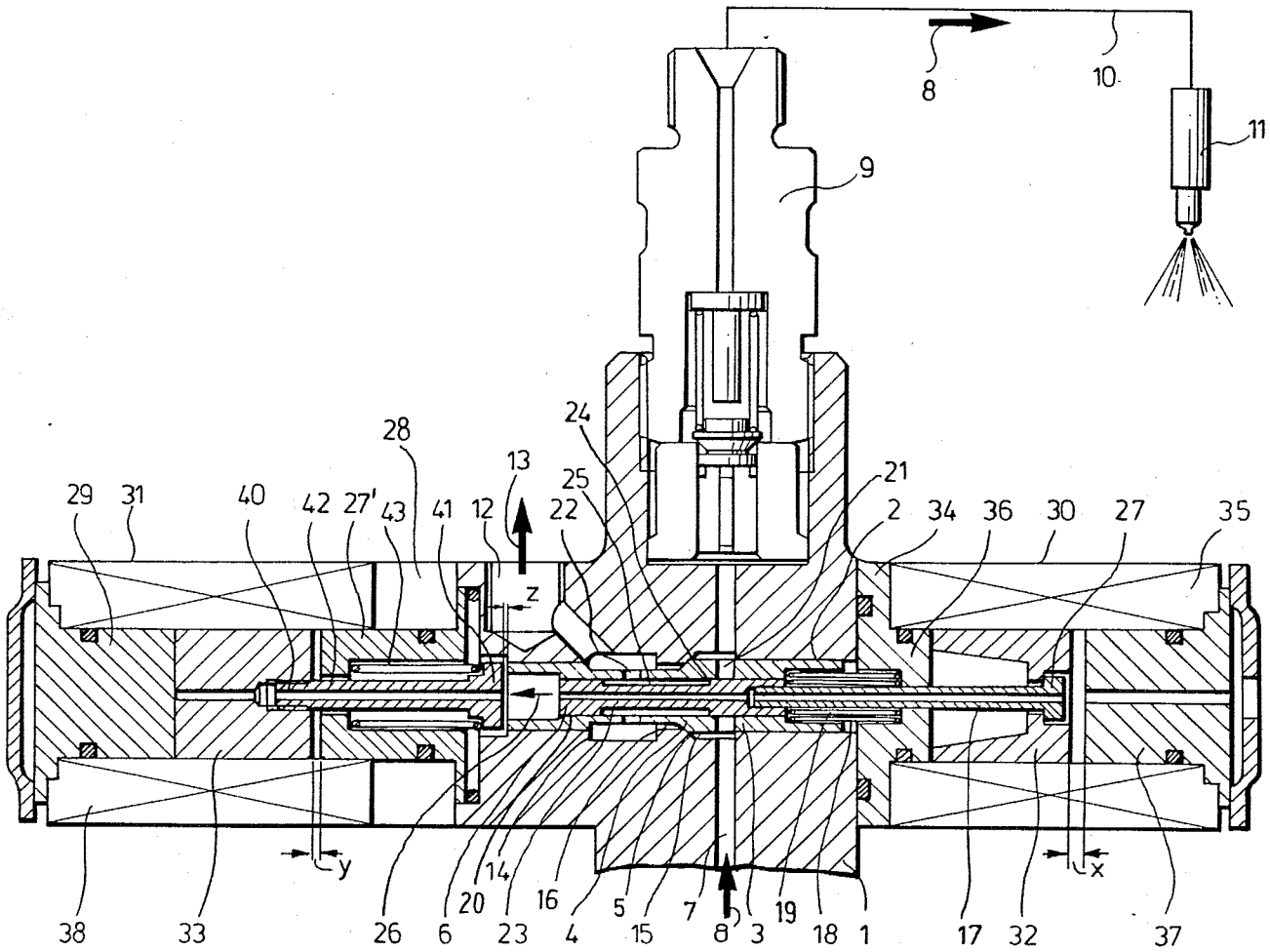
11
10
8
9
35
27
30
36
34
21
2
24
25
22
13
12
41
28
43
27'
42
40
31
29
37
x
32
17
1
18
19
3
8
7
15
5
4
16
23
14
20
6
26
z
y
33
38

FUEL INJECTION MECHANISM FOR AN INTERNAL COMBUSTION ENGINE

TECHNICAL FIELD

This invention relates to a fuel injection mechanism for an internal combustion engine, and more particularly to a fuel injection system for a diesel engine having valve means for effectively terminating injection.

PRIOR ART STATEMENT

Fuel injection arrangements have heretofore been provided wherein an electromagnetically operated valve between the injection pump and the injection nozzle effects initiation and conclusion of the fuel injection during an injection cycle, dependent on electric control signals from a central control unit.

One such fuel injection arrangement is shown in West German patent DE-OS No. 33 02 294 wherein a connecting channel is used between the dumping passage and the high pressure channel which can be closed by a valve component having a tapered shoulder which engages a complementary valve seat within the casing to form therewith a seat valve. During the injection process, the seat valve in the connecting channel is closed. The injection process is ended by opening the connecting channel which is effected by use of a spring loaded impact bolt which accelerates the valve component with a high initial impact, so that the seat valve is opened suddenly.

The initiation of the injection process of an injection cycle is determined by the closing of the seat valve. In order to achieve short switch-over times, the valve component is moved at high acceleration to its closed position, whereby the collision energy which is present during the impact of the valve onto its seat is converted partially into heat and partially into potential energy due to the resiliency of the material from which the impacting parts are made. The bouncing movements caused by the resiliency of the parts causes an oscillating closing of the valve so that the initiation of the injection is not clean and precise. In addition, fabrication variances change the bouncing movements of the valve components of a multiple-cylinder pump because of unequal frictional requirements in the individual guides as well as varying closing pressures caused by spring prestressing tolerances. This results in varying resilient bouncing movements at the valve seats and thus in deviations in the initiation of injection at the nozzles. From nozzle to nozzle, this also results in varying leakage during the closure process (volume losses) as well as an impairment of the uniform delivery capability of the nozzles.

In order to at least approximate a sudden closure of the seat valve, we know from West German patent DE-OS No. 34 27 421 that an edge can be extended in front of the valve seat which in closed position is passed over during closing of the valve component before the latter impacts against its valve seat. Because of the extended seal edge, however, an overlapping stoke is minimally necessary for opening the valve and this delay in opening must be compensated for. This solution requires a larger angle of engine rotation during opening of the valve and, as a result, the opening of the valve occurs almost precisely at a point in time at which the valve is to be closed. Thus, the valve in its closing movement must reverse itself with a delivery angle of zero degrees precisely at the point the valve clears the extended seal edge. This situation is not sufficiently stable and does not accommodate any deviations from a perfect operation.

OBJECTS AND BRIEF SUMMARY OF THE INVENTION

It is a main object of this invention to improve the design of a fuel injection mechanism in such a way that precise regulation of the initiation of discharge is possible with the least angle of delivery.

In the fuel injection mechanism of this invention, fuel injection is initiated by closing a first channel connected to a dumping passage and fuel injection is terminated by opening a second channel connected to the dumping passage. First and second valves are operatively positioned in the first and second connecting channels, respectively, for opening and closing them in response to different controls. A valve arrangement which is suitable for both the initiation and conclusion of injection can thus be provided which is adapted to the varying engine operating requirements for initiation and conclusion of the injection process.

The second valve which controls the second connecting channel includes a slide valve component which controls the initiation of injection in an advantageous manner. By using a slide valve component, such as a spool valve, a sudden closure of the second connecting channel to the dumping passage is possible, and a piston or spool-type slide valve component can be provided with an overlap range such that an adequate sealing is achieved thereby minimizing leakage. To effect the conclusion of the injection process, the first valve includes a seat valve component so as to ensure a sudden opening of the first connecting channel to the dumping passage at the end of the injection process. Such sudden opening at the end of the injection process is not possible with the slide valve without a "dead path" or overlap movement of the valve component. Because of the overlap range necessary to minimize leakage, the piston slide valve component must be moved through the overlap before the leading edge is reached to open the valve. This overlap movement is not necessary with a seat valve. It is therefore advantageous to use a seat valve for effecting the conclusion of injection, and a piston slide valve for determining the initiation of injection.

The illustrated embodiment of the invention is relatively simple in construction and has minimal space requirements. This is achieved by placing the second connecting channel within the first valve component and by making the valve components coaxial. Thus, the size of the valve is the same as that of West German patent DE-OS No. 33 02 294.

BRIEF DESCRIPTION OF THE DRAWING

One embodiment of the invention is shown in a section view of an electrically operated fuel control valve unit of a fuel injection system.

DETAILED DESCRIPTION OF THE DRAWING

The fuel injection mechanism shown in the drawing includes a casing 1 having a borehole 2 extending therethrough in which coaxial valve components 3, 6 are operatively disposed. The borehole 2 is intersected by a high pressure channel 7 which conveys the fuel which is supplied by a high pressure fuel pump, not shown, in the direction of arrow 8 through a spring loaded valve 9 to an injection line 10 connected to an injection nozzle 11. The casing includes a dumping passage 12 connected to the borehole which permits discharge of fuel from the high pressure channel in the direction of arrow 13.

The dumping passage 12 includes an annular chamber formed by a circumferential groove 14 in the wall of the borehole 2. An annular chamber formed by a circumferential recess 15 in the wall of the borehole 2 serves to interconnect inlet and outlet portions of the high pressure channel 7 regardless of the adjusted positions of the valves 3 and 6. The borehole 2 consists substantially of two sections having different diameters. The annular chamber 15 is located in the section with the greater diameter and the annular chamber 14 is located in the section with the lesser diameter. At the transition from the section with the lesser diameter to that with the greater diameter, a conical or tapered valve seat 5 is formed which faces the section with the greater diameter.

A slide valve in the form of a first valve component 3 slidingly fits in the borehole 2 and also has two sections of differing diameters. At the transition form the section with the lesser diameter to that with the greater diameter, the conical shoulder 4 is easily formed complementary to the tapered valve seat 5 because of the difference in diameters of the two sections of the valve component 3. In the drawing, the first valve component 3 is in its closed position in which its sealing surface 4 is seated on and sealingly engages the valve seat 5 thus blocking the first connecting channel 16 which connects the high pressure channel 7 with the dumping passage 12. The first connecting channel 16 is essentially formed by the borehole 2 in casing 1.

The first valve component 3 presents a central axial bore 20 which is intersected by radial boreholes 21 and 22. When the valve component 3 is in its closed position, the transverse boreholes 21, 22 connect the bore 20 with the annular chambers 14 and 15, respectively. The transverse borehole 22 which communicates with ring chamber 14 is located approximately in the middle of ring chamber 14.

A second valve in the form of a piston or spool valve component 6 is in sliding sealing engagement with the central bore 20 of the first valve component 3 and is shiftable axially between fluid flow control positions. The spool valve component 6 exhibits a circumferential groove 23 in its outer circumference, the axial width of which corresponds at least to the interval between transverse boreholes 21 and 22 in the first valve component 3. It is advantageous to provide the width of the circumferential groove in such a way that, in an open position of the second valve component 6, both transverse boreholes 21 and 22 discharge over their total transverse section into the circumferential groove 23. Here the edge of an axial front side of circumferential groove 23, which is immediately adjacent to the transverse boreholes 21, forms a leading edge 24 of the second valve component 6. In the closed position illustrated, this leading edge is located between transverse boreholes 21 and 22 so that the flow of fluid through the second connecting channel 25, which is formed by the transverse boreholes 21 and 22, bore 20 and the circumferential groove 23, is interrupted between the high pressure channel 7 and the dumping passage 12.

Electromagnetic actuators or solenoids 30, 31 are positioned in line with and at opposite ends of the borehole 2 in casing 1. The solenoids 30, 31 include axially movable armatures 32, 33, respectively. The solenoids 30, 31 are rigidly secured to the casing 1 by conventional means, not shown, with appropriate seals.

The electromagnetic actuator 30 includes an intermediate flange 34 which is designed to have a two-step diameter, whereby the small diameter portion 36 has the same diameter as the armature 32 and together with a pole core 37 functions as a support for the winding 35 of the solenoid 30. The operating range x of the armature 32 is limited on one side by the pole core 37 and on the other by the front side of the section 36 which faces the armature.

The armature 32 is coaxial with the valve components 3, 6 and is secured to the second valve component 6 by a rod-shaped connecting component 17. A head 27 of the connecting component 17 is in axial force transmitting engagement with the armature 32 in the direction of the arrow 26.

A pair of coaxial helical compression springs 18, 19 are operatively interposed between the valve components 3, 6 and the intermediate flange 34 so as to resiliently bias the valve components 3, 6 toward their closed positions. The helical springs 18, 19 are equal in length, coaxially surround the connecting component 17 and are disposed in aligned cylindrical cavities in the intermediate flange 34 and the valve component 3. The helical spring 19 abuts the end face of one axial end of the second valve component 6. The outer diameter of helical spring 19 is slightly smaller than the outer diameter of the second valve component 6 so as not to interfere with axial movement of the first valve component 3.

The helical spring 18, which resiliently biases the first valve component 3, has one end in axial abutting engagement with an interior shoulder on the first valve component 3 formed by enlargement of the axial bore 20. The inner diameter of the helical spring 18 is slightly larger than the inner diameter of the enlarged portion of the bore 20 in which it fits.

The helical spring 18 resiliently biases the first valve component 3 to a closed position in which its tapered sealing shoulder 4 engages the valve seat 5 to form a seal so that the first connecting channel 16 is closed. The spring 19, like helical spring 18, also is effective to resiliently bias the valve component in the direction of arrow 26 to maintain the second valve component 6 in its closed position. Through the axis force exerted by the compression spring 19, the second valve component 6 is shifted in the direction of arrow 26 and carries the armature 32 along with it by virtue of the connecting component 17 and its head 27, until it abuts section 36 of intermediate flange 34. In this closed position, the leading edge 24 of the second valve component 6 is located between transverse boreholes 21, 22 so that the second valve channel 25 is closed by the second valve component 6.

The second solenoid 31, which is arranged at the opposite end of borehole 2, has an intermediate flange 28 with a two-step diameter and includes a section 27' with the small diameter part which functions together with a pole core 29 as the support for the winding 38 of electromagnetic actuator or solenoid 31. The operating stroke y of the armature 33 is determined at one end by one axial end of the pole core 29 and at the other end by an axial end of section 27' of the intermediate flange 28.

The armature 33 is securely fastened with an abutment member in the form of an impact bolt 40 which extends axially through the intermediate flange 28 and presents an enlarged diameter head 41, which in an enlarged end of borehole 2 is in confronting relation to the free axial end of the first valve component 3. The abutment member 40, as well as the armature 33, are coaxial with valve components 3, 6. The outer diameter of the head 41 of the abutment member 40 is slightly smaller than the diameter of borehole 2 so that it may be freely moved into the borehole 2. The electric actuator 31, when energized, keeps the armature 33 in axial abutment with the pole core 29, in opposition to a resilient compression spring 43, which is interposed between an interior shoulder in the intermediate flange 28 and the head 41 of the impact bolt 40. In this retracted position of the impact bolt 40, the axial end of head 41 confronting the axial end of the first valve component 3 is spaced axially a distance z from the axial end of the first valve component 3. The distance z is smaller than the operating stroke y of the electromagnetic actuator 31.

In the illustrated embodiment, the electromagnetic actuator 31 is electrically energized and electromagnetic actuator 30 is not. This causes the impact bolt 40 to be retracted in opposition to the axial force of the compression spring 43 through its stroke y in the direction of arrow 26 which in turn causes the head 41 to be spaced from the axial end of the first valve component 3 by an axial distance z. The first valve component 3 is urged axially by the spring 18 to sealingly seat its tapered shoulder 4 against the valve seat 5, thereby closing or blocking the first connecting channel 6 in the direction of the arrow 26 until the armature 32 abuts section 36 of the intermediate flange 34. In this position, the leading edge 24 is located between transverse boreholes 21, 22 thereby closing the second connecting channel 25. Since both connecting channels 16, 25 are closed off from the dumping passage 12, the fuel supplied to the high pressure channel 7 in the direction of arrow 8 is delivered to the fuel injection nozzle 11 via the pressure release valve 9 secured to the casing 1 and the injection pipeline 10, which in turn is connected to an injection nozzle 11 by which fuel is injected into the combustion chamber of an internal combustion engine, not otherwise illstrated.

In order to terminate injection, the electromagnetic actuator 31 is deenergized. This permits the armature 31 to yield and the spring 43 accelerates the impact bolt 40 together with armature 33 toward the first valve component 3. After proceeding through path z, the head 41 impacts with the first valve component 3 and accelerates it suddenly in the direction opposition the direction of the arrow 26 whereby the first connecting channel 16 is suddenly opened. The fuel which is under high pressure in the high pressure channel 7 is suddenly released via the first connecting channel 16 which discharges into the dumping passage 12, thereby terminating injection. Since the leading edge 24 continues to be located between transverse boreholes 21, 22 as the first valve component 3 is moved in the direction opposite arrow 26, the second connecting channel 25 remains closed during the dumping of fuel by way of the first connecting channel 16.

After a dumping phase to end injection of fuel, the solenoid 3 is again energized by supplying it with electrical current. The impact bolt 40 is thereby returned to its retracted position and the first valve component 3, under the bias of the helical spring 18, closes the first connecting channel 16. Following termination of injection and during the period when injection is not desired, the valve 6 is kept in its open setting by energizing the solenoid 30. The valve component 6 is displaced against the force of the helical spring 19 in the direction opposite the direction of arrow 26. In this open position of the second valve component 6, the circumferential groove 23 in the second valve component 6 bridges the transverse boreholes 21, 22, connecting them in fluid communication with one anther, so that the second connecting channel 25 is opened and the fuel which is discharged under high pressure into channel 7 can be discharged via the second connecting channel 25 to the dumping passage 12. In order to control the initiation of injection, the current is shut off to the winding 35 of the electromagnetic actuator 30, thereby releasing the armature 32 from the pole core 37. When this occurs, the valve 6, under the biasing effect of helical spring 19, shifts axially through stroke x from its open position to its closed position. In the course of this movement in the direction of the arrow 26, the leading edge 24 passes beyond the aligned transverse boreholes 21 and suddenly blocks off the second connecting channel 25 so that the fuel in the high pressure channel 7 becomes pressurized and passes via the pressure release valve 9 and injection line 10 to the injection nozzle 11.

In order to conclude the supplying process, the current to the winding 38 is interrupted, whereby the impact bolt 40 moves the first valve component 3 and suddenly opens the first connecting channel 16.

In order to guarantee the axial movements of all components without a pumping action, all components of the arrangement, except for the pole core 29, are provided with boreholes which run through them axially. The axial borehole in the pole core 37 functions as a pressureless bleed-off connection for oil leakage.

The embodiments of the invention in which an exclusive property or privilege is claimed are defined as follows:

1. The fuel injection mechanism for an internal combustion engine having a casing with a borehole in which a first valve component is guided axially between an open position and a closed position in which the valve component is sealingly seated in a valve seat in the borehole to close a first connecting channel between a high pressure channel extending from an injection pump to an injection nozzle and a dumping passage wherein the valve component is spring biased toward its closed position and moved to its open position by a spring loaded impact bolt shiftable to a retracted position by an electromagnetic actuator, and further comprising a second connecting channel interconnecting said high pressure channel with said dumping passage including an axial borehole in said first valve component, a first transverse passage in said first valve component placing said axial borehole in fluid communication with said high pressure channel and a second transverse passage in said first valve component connecting said axial borehole in fluid communication with said dumping passage and a second valve component operatively disposed in said second connecting channel and shiftable between open and closed positions in which fuel flow is permitted and prevented, respectively, in said second connecting channel.

2. A fuel injection mechanism for an internal combustion engine having a casing with a borehole in which a first valve component is guided axially between an open position and a closed position in which the valve component is sealingly seated in a valve seat in the borehole to close a first connecting channel between a high pressure channel extending from an injection pump to an injection nozzle and a dumping passage wherein the valve component is spring biased toward its closed position and moved to its open position by a spring loaded impact bolt shiftable to a retracted position by an electromagnetic actuator, and further comprising:

a second connecting channel interconnecting said high pressure channel with said dumping passage, a second valve component operatively disposed in said second connecting channel and shiftable between open and closed positions in which fuel flow is permitted and prevented, respectively, in said second connecting channel and a pair of coaxial coil springs operatively interposed between said casing and said first and second valve components, respectively, and operative to bias the latter toward their respective closed positions.

3. A fuel injection mechanism for an internal combustion engine comprising:

a casing having a high pressure channel for conveying fuel from an injection pump to an injection nozzle, a dumping passage and a borehole interconnecting said high pressure channel to said dumping passage to form a first connecting channel therebetween and including an annular axially facing valve seat and a first seat valve component slidingly mounted in said borehole and having an annular seating surface complementary to and sealingly engageable with said valve seat, said seat valve being axially shiftable in said borehole between a closed position in which said seating surface sealingly engages said valve seat thereby closing said first connecting channel and an open position in which said high pressure channel is connected to said dumping passage, spring means resiliently urging said seat valve component toward its closed position, a spring loaded impact bolt at one end of said seat valve component axially shiftable between a retracted position and an impact position in which it strikes said one end of said seat valve component to suddenly move it to its open position to terminate injection of fuel, an electromagnetic actuator operatively associated with said impact bolt operable upon energization to move the latter to its retracted position, a second connecting channel interconneting said high pressure channel with said dumping passage including at least one port, and a second spool valve component mounted in said bore and including a circumferential groove constituting part of said second connecting channel, said spool valve component being axially shiftable between an open position in which said circumferential groove is in fluid communication with said port thereby permitting fuel flow in said second connecting channel from said high pressure channel to said dumping passage and a closed position in which said port is closed by said second spool valve component and fuel flow in said second connecting channel is prevented thereby initiating injection of fuel.

4. A fuel injection mechanism for an internal combustion engine having a casing with a borehole in which a first valve component is guided axially between an open position and a closed position in which the valve component is sealingly seated in a valve seat in the borehole to close a first connecting channel between a high pressure channel extending from an injection pump to an injection nozzle and a dumping passage wherein the valve component is spring biased toward its closed position and moved to its open position by a spring loaded impact bolt shiftable to a retracted position by an electromagnetic actuator, and further comprising a second connecting channel interconnecting said high pressure channel with said dumping passage and a central bore in said first valve component constituting part of said second connecting channel, a second valve component in the form of a spool valve slidingly mounted in said central bore and shiftable between open and closed positions in which fuel flow is permitted and prevented, respectively, in said second connecting channel, a first transverse passage in said first valve component between its central bore and said high pressure channel and a second transverse passage in said first valve component connecting said central bore in fluid communication with said dumping passage.

5. The fuel injection mechanism of claim 3 wherein said bore is a central coaxial bore within said first valve component.

6. The fuel injection mechanism of claim 3 and further comprising a resilient spring biasing said second valve component toward its closed position and an electromagnetic actuator operatively associated with said second valve component and operative to shift the latter to its open position upon said actuator being electrically energized.

7. The fuel injection mechanism of claim 1 and further comprising an annular recess in said axial borehole having an axial width at least equal to the axial distance said first valve component is shifted in moving form its closed to its open position and wherein said second transverse passage opens into said recess.

8. The fuel injection mechanism of claim 1 wherein said first valve component is cylindrical and has a central axial borehole therethrough and said second valve component is a spool disposed within said axial borehole and has an outer diameter corresponding to the diameter of said axial borehole and further comprising an annular circumferential groove in said outer diameter of said second valve component, the width of which equals at least the distance between said transverse passages, said circumferential groove connecting said transverse passages in fluid communication with one other when said second valve component is in its open position.

9. The fuel injection mechanism of claim 8 wherein an outer circumferential edge at an axial end of said circumferential groove forms a leading edge of said second valve component.

10. The fuel injection mechanism of claim 2 wherein said valve components are cylindrical and said second valve component is coaxially disposed within an axially extending bore in said first valve component.

11. The fuel injection mechanism of claim 2 and further comprising an electromagnetic actuator having an armature connected to said second valve component by an axial force transmitting component extending centrally through said coaxial springs.

12. The fuel injection mechanism of claim 4 and further comprising an annular circumferential groove in said outer diameter of said second valve component, the width of which equals at least the distance between said transverse passages, said circumferential groove connecting said transverse passages in fluid communication with one another when said valve component is in its open position.

13. The fuel injection mechanism of claim 12 wherein an outer circumferential edge at an axial end of said circumferential groove forms a leading edge of said second valve component.

* * * * *

UNITED STATES PATENT OFFICE

CERTIFICATE OF CORRECTION

Patent No. 4,785,787 Dated November 22, 1988

Inventor(s) Reda R. Rizk and Hans-Gottfried Michels

It is certified that error appears in the above-identified patent and that said Letters Patent are hereby corrected as shown below:

Title page:

Change the last name of the first named inventor to "Rizk";

Col. 7, line 51, "interconneting" should be "interconnecting";

Col. 8, line 40, "form" should be "from".

Signed and Sealed this

Fourth Day of April, 1989

*Attest:*

*Attesting Officer*

DONALD J. QUIGG

*Commissioner of Patents and Trademarks*